US009743175B2

(12) United States Patent
Akino

(10) Patent No.: US 9,743,175 B2
(45) Date of Patent: Aug. 22, 2017

(54) MICROPHONE AND MICROPHONE HOUSING

(71) Applicant: Hiroshi Akino, Tokyo (JP)

(72) Inventor: Hiroshi Akino, Tokyo (JP)

(73) Assignee: KABUSHIKI KAISHA AUDIO TECHNICA, Tokyo (JP)

( * ) Notice: Subject to any disclaimer, the term of this patent is extended or adjusted under 35 U.S.C. 154(b) by 0 days.

(21) Appl. No.: 15/055,694

(22) Filed: Feb. 29, 2016

(65) Prior Publication Data

US 2016/0261950 A1 Sep. 8, 2016

(30) Foreign Application Priority Data

Mar. 5, 2015 (JP) ..... 2015-43131

(51) Int. Cl.

| | |
|---|---|
| ***H04R 9/08*** | (2006.01) |
| ***H04R 1/34*** | (2006.01) |
| ***H04R 1/02*** | (2006.01) |
| ***H04R 1/04*** | (2006.01) |
| ***H04R 1/08*** | (2006.01) |

(52) U.S. Cl.

CPC ..... *H04R 1/342* (2013.01); *H04R 1/028* (2013.01); *H04R 1/04* (2013.01); *H04R 1/086* (2013.01)

(58) Field of Classification Search

CPC combination set(s) only.
See application file for complete search history.

(56) References Cited

U.S. PATENT DOCUMENTS 9,020,179 B2 * 4/2015 Akino ..... H04R 1/326 381/356

FOREIGN PATENT DOCUMENTS

| | | |
|---|---|---|
| JP | 4939922 | 5/2012 |
| JP | 5449932 | 3/2014 |

* cited by examiner

*Primary Examiner* — Amir Etesam
(74) *Attorney, Agent, or Firm* — Whitham, Curtis & Cook

(57) ABSTRACT

A microphone includes a microphone unit that converts a sound into an electrical signal. A tubular housing houses the microphone unit and includes a rear opening portion in a side surface. A step portion surrounds the rear opening portion in an inner surface of the housing. A plate-like shielding member is attached to the step portion from an inner surface side of the housing, and a circuit board housed in the housing in contact with the shielding member includes a ground pattern its side surface and in a contact position between the circuit board and the shielding member.

8 Claims, 16 Drawing Sheets

MICROPHONE AND MICROPHONE HOUSING

BACKGROUND OF THE INVENTION Technical Field

The present invention relates to a microphone and a microphone housing. Background Art As illustrated in FIG. 14, among microphones 100, for example, unidirectional condenser microphones, there is one in which a circuit board 160 that configures an electronic circuit is arranged in proximity to the rear of a diaphragm of a microphone unit 110. Further, the unidirectional condenser microphone takes in sounds from two directions from the front and the rear of the diaphragm in order to realize unidirectionality. Therefore, a front cover 130 in front of a housing 120 includes a front opening portion 131. Further, as illustrated in FIG. 15, the housing 120 that houses the microphone unit 110 of the unidirectional condenser microphone includes a rear opening portion 121 in its side surface.

The circuit board in which an impedance converter is mounted is installed near the rear opening portion 121 in the side surface of the housing 120. Therefore, in the microphone 100, when a high-frequency current comes in from a vicinity of the rear opening portion 121, the impedance converter detects the high-frequency current, and noises occur. To suppress the noises, a shielding member 150 made of a metal mesh or a punching metal cut in a strip manner is provided in the rear opening portion 121, and configures electrostatic shielding.

An opening area of the rear opening portion 121 of the housing 120 is required to be large to efficiently take in the sounds. Further, if the opening area of the rear opening portion 121 is large, external electromagnetic waves are easily mixed. Therefore, the shielding member is required to be attached in a reliable manner.

As illustrated in FIG. 16, conventionally, the shielding member 150 has a cylindrical shape, and is housed inside the housing 120 along the side surface of the housing 120 and is fixed with an adhesive or the like. However, the shielding member 150 is sometimes shifted from an original fixing position because sufficient stress is not applied when the shielding member 150 is fixed inside the housing 120. In this case, the shielding member 150 cannot reliably cover the rear opening portion 121 inside the housing 120, and cannot obtain high electrostatic shielding performance. Further, to obtain the high electrostatic shielding performance, the shielding member 150 is required to be grounded with a short conductive path.

JP 4939922 B discloses a capacitance microphone provided with a coil spring that presses a metal mesh against an inner wall surface of a unit case in order to perform electromagnetic shield in a rear acoustic terminal of the microphone.

JP 5449932 B discloses a capacitance microphone in which a plurality of openings that allows sound waves to pass through is formed in a shielding plate of the microphone.

The technologies disclosed in JP 4939922 B and JP 5449932 B cannot make a ground path of a shielding member short because the shielding member may be fixed while remaining shifted. Therefore, it is difficult to obtain the high electrostatic shielding performance with the technologies disclosed in these patent documents. In addition, the technology disclosed in JP 4939922 B requires the coil spring that presses the metal mesh, and thus the configuration becomes complicated.

SUMMARY OF INVENTION

An object of the present invention is to provide a microphone that can obtain high electrostatic shielding performance with a simple configuration.

According to the present invention, there is provided a microphone including: a microphone unit configured to convert a sound into an electrical signal; a tubular housing that houses the microphone unit; an opening portion provided in a side surface of the housing; a step portion provided to surround the opening portion in an inner surface of the housing; a plate-like shielding member attached to the step portion from an inside of the housing; and a circuit board housed in the housing in contact with the shielding member, and including a ground pattern provided on a side surface of the circuit board and in a contact position between the circuit board and the shielding member.

DESCRIPTION OF THE PREFERRED EMBODIMENTS

Hereinafter, a microphone and a microphone housing according to the present invention will be described with reference to the drawings.

Microphone (1)

Figure 1:
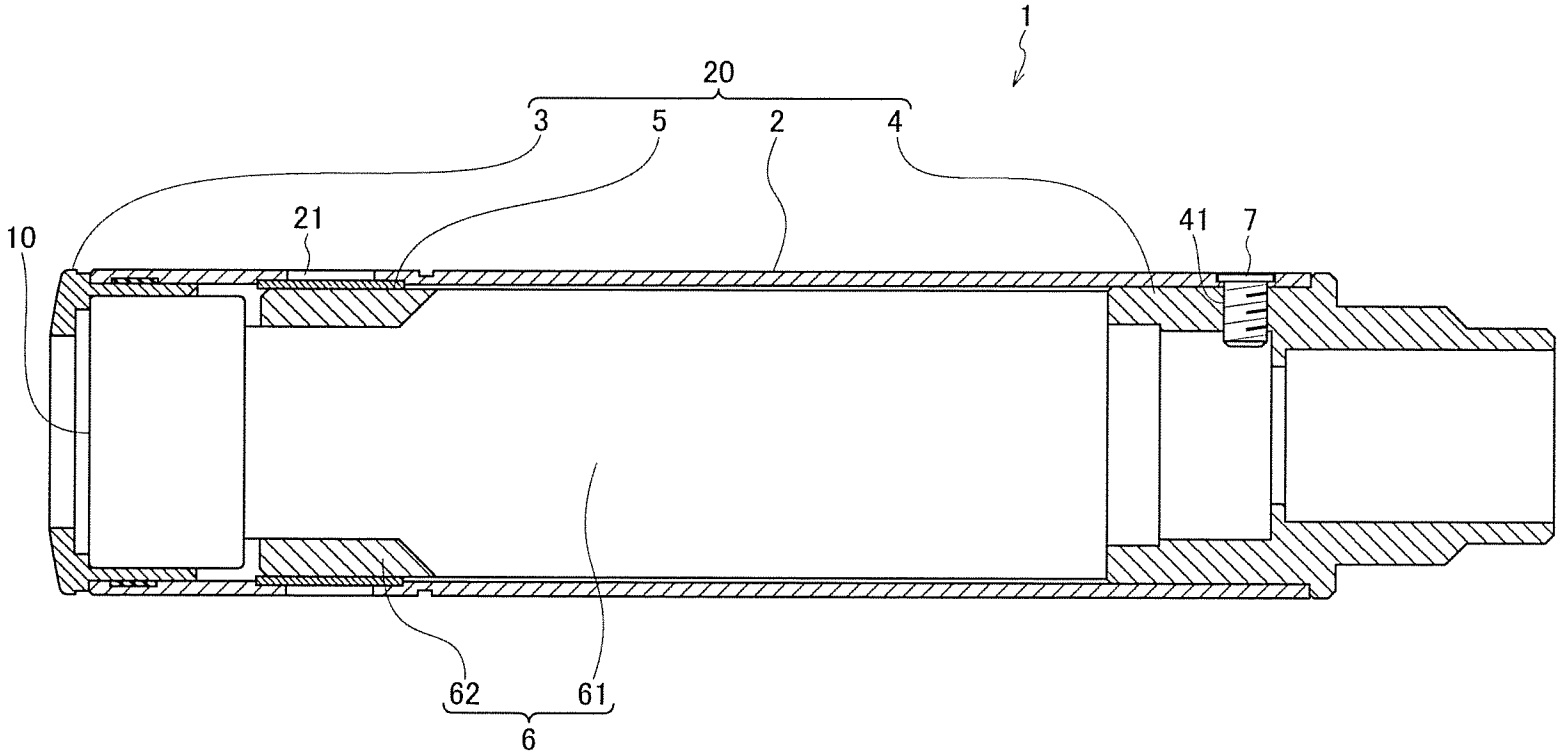
FIG. 1 is a side sectional view illustrating an embodiment of a microphone according to the present invention.

As illustrated in FIG. 1, a microphone 1 according to the present embodiment includes a cylindrical housing body 2 including a rear opening portion 21, a front cover 3 that covers one opening end of the housing body 2, a tail piece 4 that covers the other opening end, and a metal mesh 5 that covers the rear opening portion 21. The housing body 2, the front cover 3, the tail piece 4, and the metal mesh 5 configure a microphone housing 20 according to the present embodiment. The microphone housing 20 houses a microphone unit 10 and a circuit board 6 therein.

In the microphone 1, a side of the housing body 2 where the front cover 3 is attached is a front side (a left side on the paper surface of FIG. 1), and a side where the tail piece 4 is provided, the side being opposite to the aforementioned side, is a rear side (a right side on the paper surface of FIG.

Figure 2:
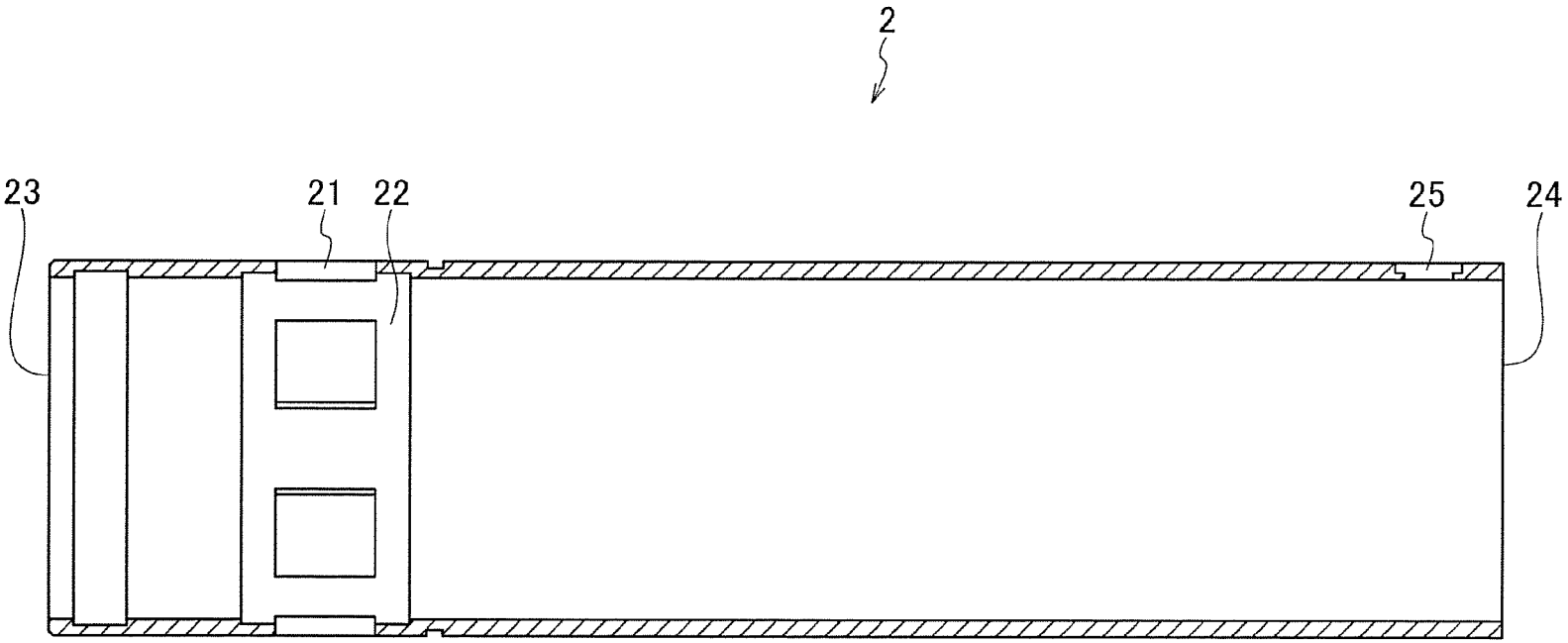
FIG. 2 is a side sectional view illustrating a housing body of the microphone of FIG. 1.

A configuration of the housing body 2 will be described with reference to FIG. 2. The housing body 2 has a tubular shape such as a cylindrical shape long in a front and rear direction. The housing body 2 has a cavity for housing the microphone unit 10 and the circuit board 6 therein. Further, the housing body 2 has an opening end 23 where the front cover 3 is attached in one end, and an opening end 24 to which the tail piece 4 is attached in the other end. The housing body 2 is formed of a conductive material such as metal in order to perform electrostatic shielding of the microphone unit 10 from an outside. In the housing body 2, a hole 25 into which a screw 7 for fixing the tail piece 4 is inserted is provided.

Note that the material of the housing body 2 is not limited to metal, and may be a resin such as plastic. When the housing body 2 is formed of a resin, at least an inner wall of the housing body 2 may have conductivity by plating or the like. When an outer wall of the housing body 2 is similarly plated, and the outer wall and the inner wall are conducted, an effect of the electrostatic shielding is improved. Use of such a housing body 2 can provide a light microphone. Since the housing body 2 is used for a unidirectional microphone, the housing body 2 includes the slit-like rear opening portion 21 through which sounds are taken in from a back surface side of a diaphragm. A plurality of the rear opening portions 21 is provided in a side surface close to the front-side opening end 24.

The rear opening portions 21 are equally provided in the side surface of the housing body 2 in order to uniformly take in the sounds from the back surface side of the diaphragm. To be specific, the rear opening portions 21 mutually have the same shape and are arranged at equal intervals. There is a rear acoustic terminal that is a central position of the air moving with the diaphragm, near the rear opening portions 21, when the microphone unit 10 is integrated.

A step portion 22 is provided at an inner side of the rear opening portions 21. The step portion 22 is a portion provided along an inner periphery of the housing body 2, and is a portion thinner in thickness than other portions of the inner wall of the housing body 2. An inner diameter of the step portion 22 is larger than an inner diameter of the housing body 2. The step portion 22 holds the metal mesh 5 in a predetermined position at an inner side of the housing body 2, when the metal mesh 5 is attached to the inner side of the housing body 2.

As illustrated in FIG. 1, the metal mesh 5 is attached to the inner side of the rear opening portions 21 throughout the entire step portion 22 in a peripheral direction. The circuit board 6 in which an impedance converter made of an FET is mounted is arranged in a vicinity of the rear opening portions 21 in the housing body 2. A sound signal output from the microphone unit 10 is transmitted to an external device through the circuit board 6 and transmission lines (for example, a balanced two-core shielded wire, not illustrated) . At this time, when the circuit board 6 is arranged near the rear opening portions 21, components such as the FET easily detect external electromagnetic waves, and noises are easily mixed in the sound signal. To avoid such mixture of the noises in a path of the sound signal, the metal mesh 5 is provided at the inner side of the rear opening portions 21 as a shielding member, for example, to apply the electrostatic shielding to the path of the sound signal.

Figure 3:
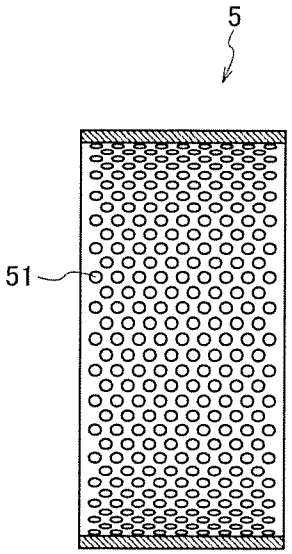
FIG. 3 is a side sectional view illustrating a metal mesh of the microphone of FIG. 1.
Figure 4:
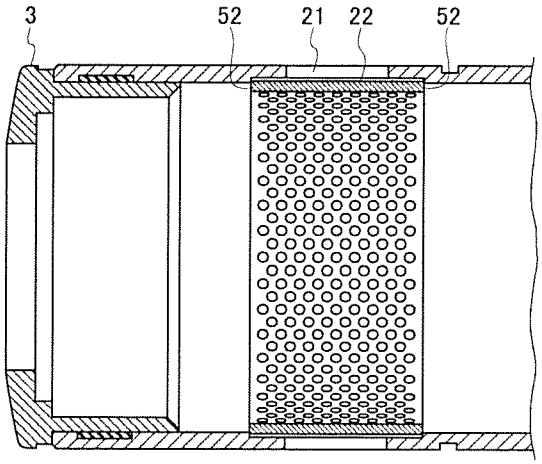
FIG. 4 is an enlarged side sectional view illustrating a tip portion of the housing body in a state where a front cover is assembled.

As illustrated in FIG. 3, the metal mesh 5 is configured such that a plurality of holes 51 is provided in a strip-like metal member in order to secure circulation of the sound waves through the rear opening portions 21 while applying the electrostatic shielding to the path of the sound signal, as described above. Since the metal mesh 5 is attached along the inner side of the housing body 2, the metal mesh 5 is formed of a strip-like member, that is, a plate-like member that is rounded in a cylindrical shape. As illustrated in FIG. 4, a dimension of the cylindrical metal mesh 5 in a radial direction corresponds to an inner diameter of the step portion 22 so that the metal mesh 5 is stopped at the step portion 22 in an engaged state. Further, the dimension of the metal mesh 5 in the front and rear direction accords with the dimension of the step portion 22 in the front and rear direction so that the metal mesh 5 is stopped at the step portion 22 in an engaged state and the position of the metal mesh 5 inside the housing body 2 is held. The metal mesh 5 is formed of a more rigid material than ground patterns 62 described below.

Figure 5:
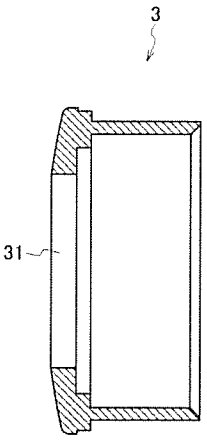
FIG. 5 is a side sectional view illustrating the front cover of the microphone of FIG. 1.

As illustrated in FIG. 1, the front cover 3 that covers the microphone unit 10 inside the housing body 2 is arranged in the opening end 23 at the front side of the housing body 2. The front cover 3 is formed of a conductive material such as metal in order to perform the electrostatic shielding of the microphone unit 10 from an outside. The front cover 3 needs to take in the sound from a front surface side of the housing body 2, toward a front surface side of the diaphragm. Therefore, as illustrated in FIG. 5, a plurality of slit-like opening portions 31 is provided in the front cover 3. There is a front acoustic terminal that is a central position of the air moving with the diaphragm at the same time, at a front surface side of the front opening portions 31.

The tailpiece 4 is provided in the opening end 24 at the rear side of the housing body 2. The tail piece 4 includes a screw hole 41 corresponding to the hole 25 provided in the housing body 2, and is screwed with a screw 7. The tail piece 4 is formed of an elastic body such as a rigid plastic so as to be easily fit into the housing body 2. The tail piece 4 has a hollow structure penetrating from one end at the front side of the member to the other end at the rear side of the member in order to wire cables and the like near the center.

The microphone unit 10 is mounted inside the housing body 2, and converts the sound into a sound signal that is an electrical signal, and outputs the electrical signal. The microphone unit 10 is a condenser microphone unit, for example, and includes the diaphragm and a fixed pole in order to convert the sound into the sound signal and output the sound signal. The circuit board 6 is attached at a rear side of the microphone unit 10.

Figure 6:
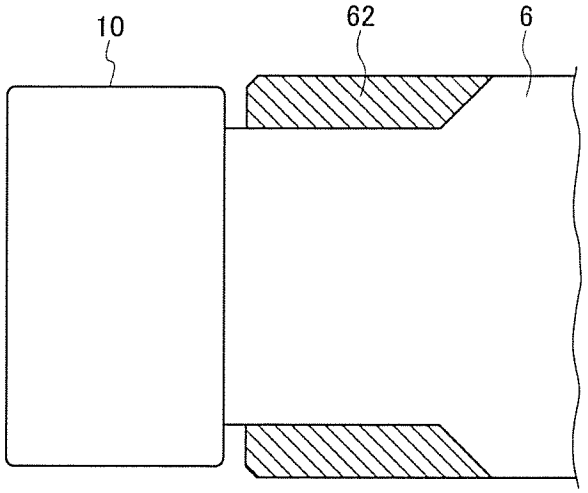
FIG. 6 is an enlarged side view illustrating a microphone unit and a circuit board of the microphone of FIG. 1.
Figure 7:
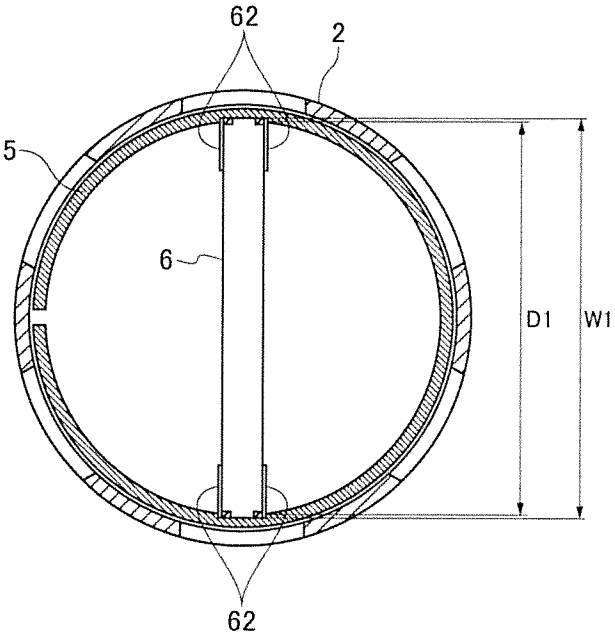
FIG. 7 is a front sectional view illustrating dimensions of the housing body and the circuit board.

The circuit board 6 has an approximately rectangular plate shape where the front and rear direction is a longitudinal direction, and is housed in the housing body 2. The circuit board 6 includes board surfaces 61 that configure an electrical circuit and ground patterns 62. The board surfaces 61 are provided on both surfaces of the circuit board 6. As illustrated in FIGS. 1 and 7, the ground patterns 62 are provided in end portions in a width direction of the board surfaces 61 at the front side. The ground patterns 62 are provided to extend over a part of a surface (that is, a side surface) of the circuit board 6 in a thickness direction. Positions where the ground patterns 62 are provided correspond to contact positions of the circuit board 6 and the metal mesh 5 when the circuit board 6 is inserted into the housing body 2. As illustrated in FIG. 6, the microphone unit 10 is attached to the front side of the circuit board 6 at the time of assembling the microphone 1.

As illustrated in FIG. 7, a dimension W1 of the circuit board 6 in the width direction is approximately the same as an inner diameter D1 of the metal mesh 5 housed in the housing body 2 so that the circuit board 6 can be housed in the housing body 2. To be specific, the dimension W1 of the circuit board 6 is slightly larger than the inner diameter D1 of the metal mesh 5.

Figure 8:
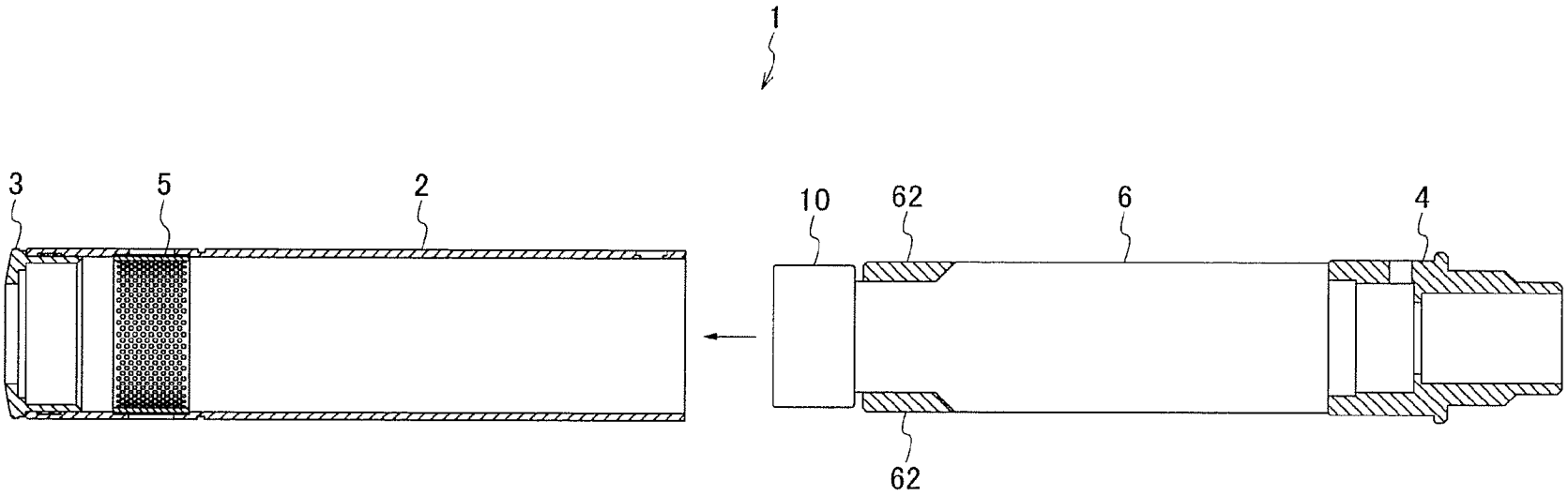
FIG. 8 is a schematic view illustrating a process of assembling the microphone unit and a microphone housing of the microphone of FIG. 1.

As illustrated in FIG. 8, in assembling the microphone 1, the circuit board 6 is inserted into the housing body 2 in a state where the metal mesh 5 illustrated in FIG. 4 is housed in the housing body 2. At this time, the microphone unit 10 is attached to the front end of the circuit board 6. After insertion of the circuit board 6 into the housing body 2, the rear end of the circuit board 6 is pushed with the tail piece 4.

Figure 9:
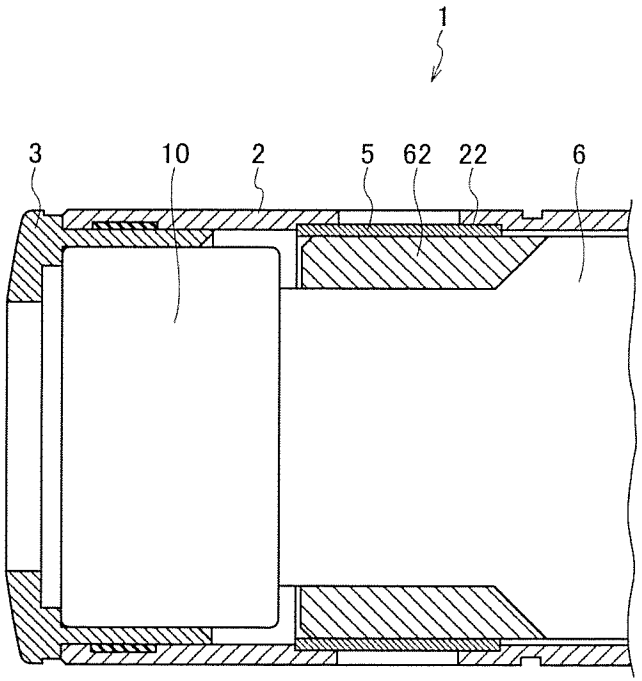
FIG. 9 is an enlarged side sectional view illustrating a tip portion of the microphone of FIG. 1.
Figure 10:
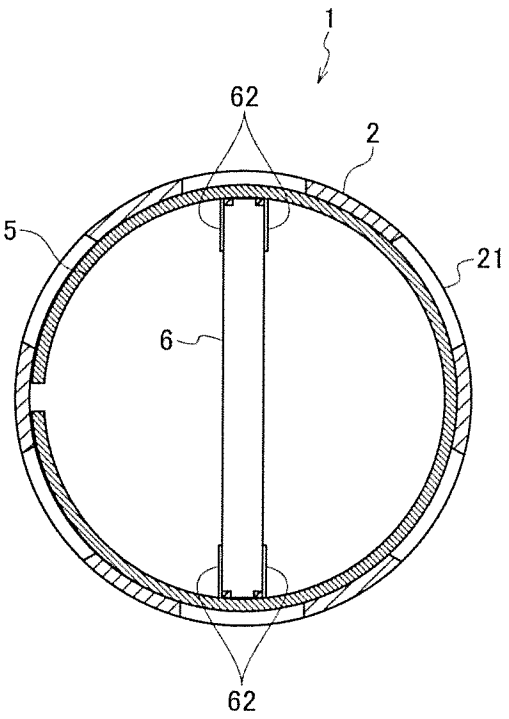
FIG. 10 is a front sectional view of the microphone of FIG. 1.

As illustrated in FIG. 7, the dimension W1 of the circuit board 6 inserted in the housing body 2 in a short direction is slightly larger than the inner diameter D1 of the metal mesh 5. Therefore, as illustrated in FIGS. 9 and 10, the metal mesh 5 stopped at the step portion 22 in an engaged manner is pressed toward the inner wall of the housing body 2 by the circuit board 6. The metal mesh 5 comes in close contact with the inner wall of the conductive housing body 2 as described above, so that a contact property between the metal mesh 5 and the housing body 2 becomes favorable, and electrical connection near the rear opening portion 21 is secured. Therefore, the electrostatic shielding is formed near the rear opening portion 21. Further, since the ground patterns 62 of the circuit board 6 come in contact with the metal mesh 5, the inner surface of the metal mesh 5 is electrically connected with the ground patterns 62. That is, the housing body 2, the metal mesh 5, and the ground patterns 62 are electrically connected. Therefore, according to the microphone 1, the ground path of the housing becomes short, whereby the effect of the electrostatic shielding can be enhanced.

Microphone (2)

Another embodiment of a microphone according to the present invention will be described, mainly about different points from the embodiment described above.

Figure 11:
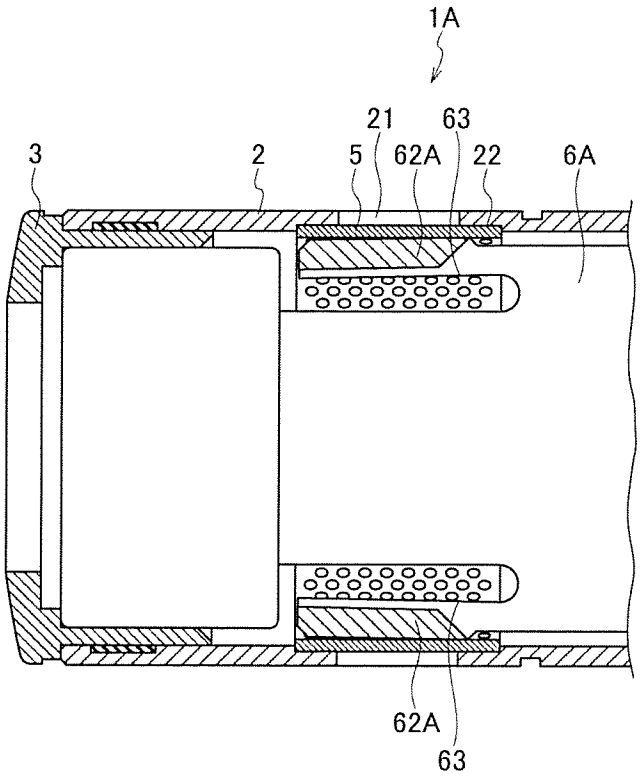
FIG. 11 is an enlarged side sectional view of a tip portion illustrating another embodiment of a microphone according to the present invention.
Figure 12:
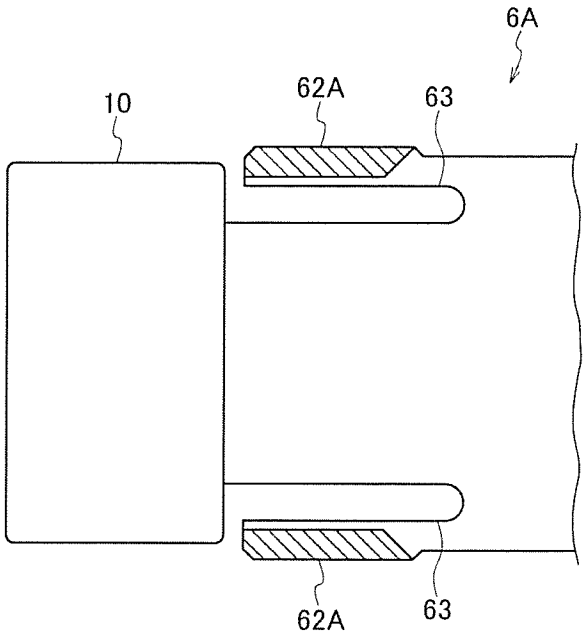
FIG. 12 is an enlarged side view illustrating a microphone unit and a circuit board of the microphone of FIG. 11.

As illustrated in FIG. 11, a microphone 1A according to the present embodiment is different from the microphone 1 described above in that notches 63 are provided in positions near positions where ground patterns 62A are provided, to be specific, positions close to a center of a circuit board 6A. As illustrated in FIG. 11, the notches 63 are located inside the ground patterns 62A, and are formed parallel to the ground patterns 62A. As illustrated in FIG. 12, the notches 63 bend vicinities of the ground patterns 62A of the circuit board 6A when the circuit board 6A is inserted into a housing body 2. At this time, the notches 63 function as elastic force generating portions that exert elastic force in a direction of pressing an inner wall of the housing body 2, and also function as a buffer material that adjusts a dimension in the housing body 2.

Figure 13:
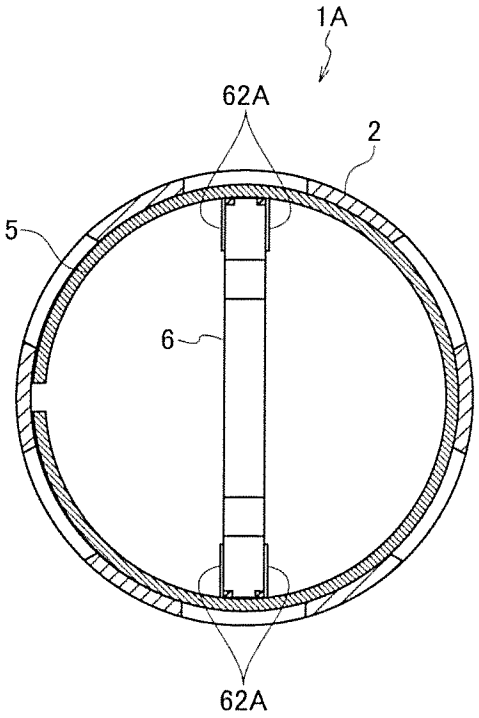
FIG. 13 is a front sectional view of the microphone of FIG. 11.
Figure 14:
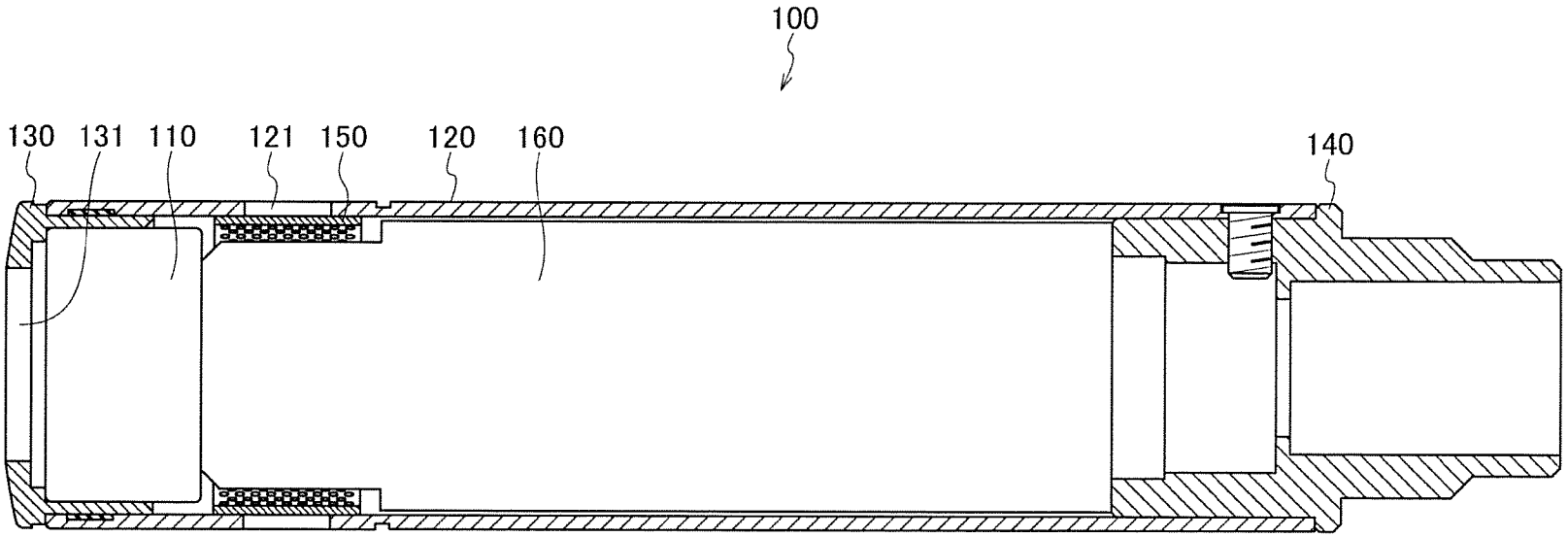
FIG.14 RELATED ART
FIG. 14 is a side sectional view illustrating a microphone of a related art.
Figure 15:
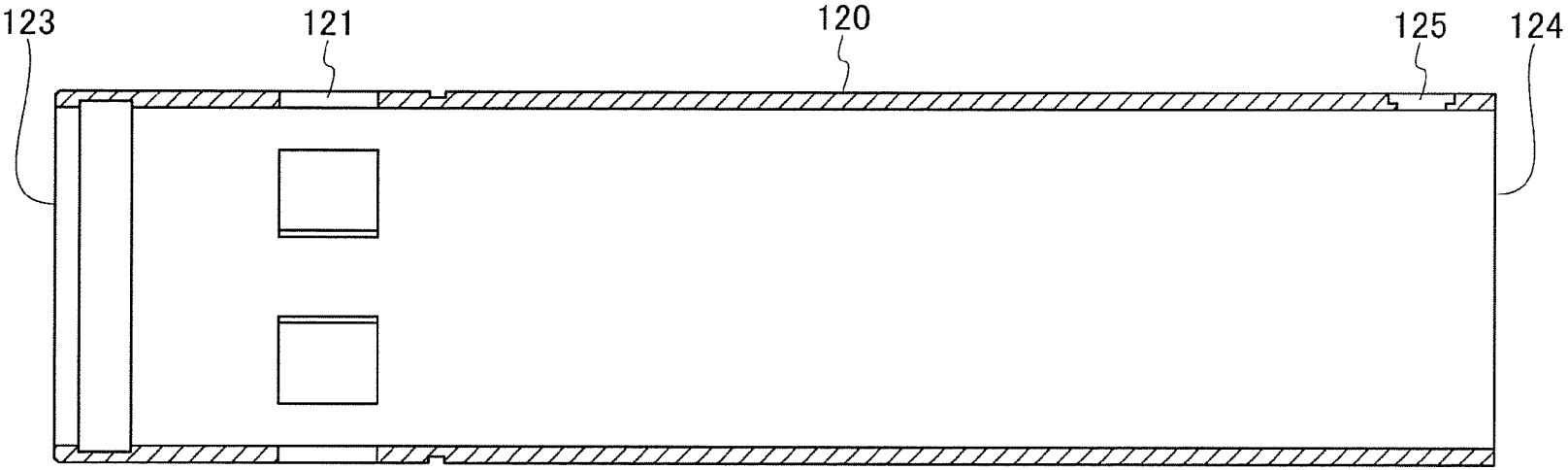
FIG.15 RELATED ART
FIG. 15 is a side sectional view illustrating a housing body of a microphone of a related art.
Figure 16:
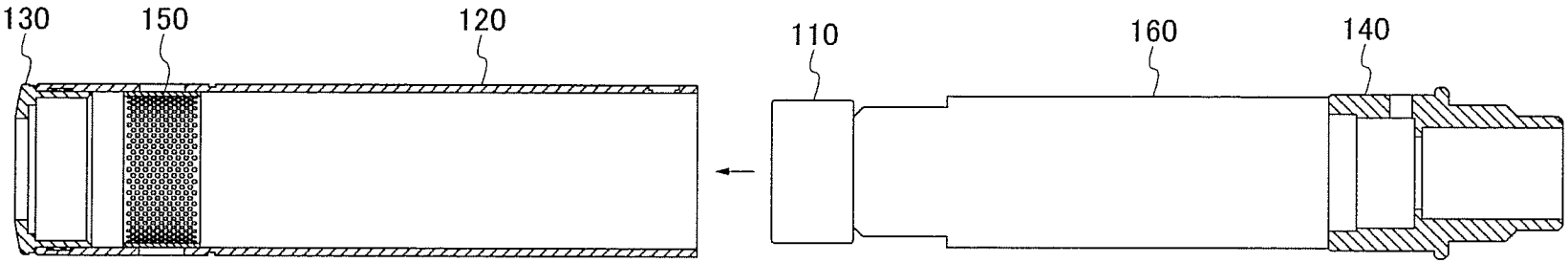
FIG. 16 RELATED ART
FIG. 16 is a schematic view illustrating a process of assembling a microphone unit and a microphone housing of a microphone of a related art.

As illustrated in FIG. 13, the ground patterns 62A are reliably in contact with a metal mesh 5 by the elastic force of the circuit board 6A near the ground patterns 62A with the notches 63. Therefore, according to the microphone 1A, a contact property between the metal mesh 5 and the housing body 2 becomes favorable, and electrical connection near a rear opening portion 21 can be secured. Therefore, an effect of electrostatic shielding near the rear opening portion 21 can be enhanced.

The microphones of the above-described embodiments can obtain high electrostatic shielding performance with a simple structure.

What is claimed is:

1. A microphone comprising:

a microphone unit configured to convert a sound into an electrical signal;

a tubular housing that houses the microphone unit;

an opening portion provided in a side surface of the housing;

a step portion provided to surround the opening portion in an inner surface of the housing;

a plate-like shielding member attached to the step portion from an inside of the housing; and a circuit board housed in the housing in contact with the shielding member, and including a ground pattern provided on a side surface of the circuit board and in a contact position between the circuit board and the shielding member.

2. The microphone according to claim 1, wherein the shielding member is electrically connected with the housing and the ground pattern.

3. The microphone according to claim 1, wherein a dimension of the circuit board in a width direction is the same as an inner diameter of the housing.

4. The microphone according to claim 1, wherein the microphone unit is attached to one end of the circuit board.

5. The microphone according to claim 1, wherein a transverse sectional shape of the housing is a circle.

6. The microphone according to claim 1, wherein the shielding member is formed of a material that is more rigid than the ground pattern.

7. The microphone according to claim 1, wherein the circuit board includes an elastic force generating portion near the ground pattern.

8. A microphone housing comprising:

a tubular housing that houses a microphone unit that converts a sound into an electrical signal;

an opening portion provided in a side surface of the housing;

a step portion provided to surround the opening portion in an inner surface of the housing;

a plate-like shielding member attached to the step portion from an inner surface side of the housing; and a circuit board housed in the housing in contact with the shielding member, and including a ground pattern provided on a side surface of the circuit board and in a contact position between the circuit board and the shielding member.

* * * * *